United States Patent [19]

Dailey

[11] Patent Number: 4,610,348

[45] Date of Patent: Sep. 9, 1986

[54] CASE FOR DISPLAYING LIPSTICK

[76] Inventor: Gloria A. Dailey, 9 Montauk Ct., St. Louis, Mo. 63146

[21] Appl. No.: 722,660

[22] Filed: Apr. 12, 1985

[51] Int. Cl.[4] ..... B65D 5/50

[52] U.S. Cl. ..... 206/45.19; 206/563

[58] Field of Search ..... 206/589, 45.11, 45.19, 206/45.14, 562, 563, 588, 590

[56] References Cited

U.S. PATENT DOCUMENTS

| | | | |
|---|---|---|---|
| 1,110,051 | 9/1914 | Harpster | 206/589 |
| 1,812,311 | 6/1931 | Wolf | 206/589 |
| 3,167,235 | 1/1965 | Hailey et al. | 206/589 |
| 3,203,540 | 8/1965 | Kalt et al. | 206/589 |
| 3,682,597 | 8/1972 | Husch | 206/589 |

OTHER PUBLICATIONS

Two photographs of a lipstick case understood to be in use by Avon salespersons to contain demonstrator tubes of lipstick. The the applicant has been told this Avon case has been in public use for about three years, but the applicant has no personal knowledge of such use.

*Primary Examiner*—Joseph Man-Fu Moy

*Attorney, Agent, or Firm*—Rogers, Howell, Moore & Haferkamp

[57] ABSTRACT

A case for storing and displaying lipstick having a bottom section. A top section acts as a removable cover for the bottom section. A tray spaced above the bottom panel of the bottom section. An even number of holes through the tray each pair of which receives a tube of lipstick and the cap therefor adjacent thereto. With the top section in place a plurality of tubes of lipstick can be stored with the caps removed and with protection from dust. With the top section removed the lipstick colors are in full view for selection of the appropriate lipstick for a particular use.

11 Claims, 6 Drawing Figures

CASE FOR DISPLAYING LIPSTICK

FIELD OF THE INVENTION

This invention relates to a case for storing and displaying lipstick and particularly to a case for storing and displaying a plurality of tubes of lipstick with the caps removed from the tubes to uncover the lipstick and allow selection of lipstick according to its color.

Commercially sold lipstick is available in a very large variety of colors and shades. Each color is considered especially and specifically suitable for matching or complementing a woman's apparel and/or accessories. Even though hair and skin color may have an influence on the different colors of lipstick that would be most appropriate for a particular person, each color itself has many different shades and variations of shades. Therefore, even if the most appropriate colors are limited to less than all colors of the spectrum, the different shades of only one color can be large in number. Thus, it is common for a woman to have many tubes of lipstick. Sometimes a new color will become attractive and another tube of lipstick will be acquired. Conversely, from time to time the lipstick from a tube will become exhausted and the tube and its cap will be discarded.

A frequent problem almost every woman has is where to store these tubes of lipstick. Also, in most cases, the color of lipstick can only be determined by removing the individual cap from a tube to view the lipstick or by looking at the bottom of the tube and reading a label. At present, then, considerable time is involved in not only selecting a proper color but finding the lipstick that is of the desired color. Sometimes the owner may not remember that she has lipstick of a particular color and, not accidentally discovering it when searching through her lipstick collection, she will settle for a lipstick color that may not be the optimum color available in her collection. Absent a suitable way to store tubes of lipstick, they are frequently put in the drawer of a dresser or dressing table where they can roll about and sometimes be hidden behind other objects within the drawer. At other times, the tubes of lipstick may be collected within a box or within a tray. In all of these examples, the caps are left on the lipstick to protect the lipstick from getting dust and dirt particles on it or from contacting other objects. With the caps on the lipstick tubes, the colors of the different lipsticks are hidden. While sometimes color labels can be read, more frequently, the selection process involves removing the caps from all the tubes until the desired color is selected. Again, this may result in a hurried selection of less than the optimum color available in the collection.

There are times when lipstick is stored in a refrigerator to prevent it from becoming too soft. At present there is no convenient way to contain the lipstick for such storage, so frequently several tubes may simply be put on a dinner plate or in a pan. The present invention solves this problem by providing a case for storing and displaying lipstick that can be put on the shelf of a refrigerator with a cover on the case that protects the lipstick from contact with anything in the refrigerator as well as against food odor.

SUMMARY OF THE INVETNION

This case for storing and displaying lipstick has a bottom section and a top section. The top section is removable to alternately open and close access to the bottom section. If desired, the top section could be hinged to or slidable relative to the bottom section. A stiff tray is supported within the bottom section, preferably on legs or by other means that space the tray above the bottom panel of the bottom section. There are an even number of holes through the tray arranged in rows. Each pair of holes is sized to receive a lipstick tube and its cap. Because the tube is stored next to its cap, it is also important that each row consist of an even number of holes. Since the tray is spaced above the bottom of the case, the walls that define the holes will support the tubes and the caps upright while they rest on the bottom panel of the bottom section. The tubes are oriented and held so that the lipstick faces upwardly, thereby making the colors readily visible from above. When the top section is in place closing the bottom section, the case is enclosed and the lipstick is protected from dust and foreign matter. This allows the caps to be left removed from the tubes during storage so the lipstick colors are always exposed for viewing. Therefore, simply removing the top section affords a view of all the lipstick colors. When one is selected, its tube and cap are removed, thereafter to be replaced such as at the end of a day.

The capacity of the case is determined by the number of holes through the tray. Thus, a standard case might have twenty-four holes in its tray to hold twelve tubes and caps whereas a small case might have ten or twelve holes. While the shape and size of the case can be as desired, the case should be tall enough to accommodate the tallest of the normally commercially available lipsticks and tubes. Also, the space between adjacent holes should be greater than the thickness of a person's thumb or finger to allow grasping and removal of the selected tube and its cap.

DESCRIPTION OF THE PREFERRED EMBODIMENT

Figure 1:
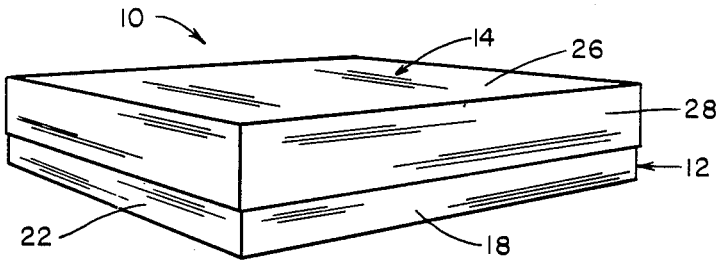
FIG. 1 is an isometric view of the case for storing and displaying lipstick with the top section in place on the bottom section.

Referring to FIG. 1, this case 10 for storing and displaying lipstick has a bottom section 12 and a top section 14. The bottom section 12 has a flat bottom panel 16, a front panel 18, a back panel 20 and side panels 22 and 24. The top section 14 has a top panel 26, a front panel 28, a back panel 30 and side panels 32 and 34. Although the case 10 may be made of any suitable material, it is preferably made of relatively stiff plastic. The top section 14, or at least the top panel 26, may be of transparent plastic so that the interior of the case 10 can be seen without removal of the top section 14. In fact, if desired, the entire case 10 can be of transparent material.

A tray 36 is positioned within the bottom section 12. The tray 36 is supported on the botton panel 16 of the bottom section 12 preferably by legs 37 glued or otherwise suitably fastened to the tray 36. The legs 37 preferably are located at the corners of the tray 36 to leave the central area under the tray clear of obstructions. This construction permits removal of the tray, providing access for cleaning the entire bottom section 12 as well as both sides of the tray 36.

The tray 36 has a plurality of holes 38 through it. The holes 38 are in rows. The holes 38 preferably are round, but they may be square or polygonal. These holes 38 are preferably spaced from one another a distance of about $\frac{3}{4}$ inch, which is slightly greater than the thickness of a person's thumb, typically about $\frac{5}{8}$ inch, and the holes 38 are preferably spaced from the front, back and side panels 18, 20, 22 and 24 by about the same distance. The holes 38 are used in pairs, so there should be an even number of holes. Also, the holes in each row should be an even number. Each pair of holes 38 is adapted to receive a lipstick tube and its cap.

Figure 4:
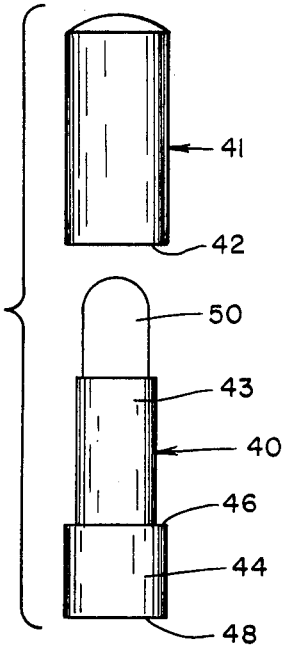
FIG. 4 is a side elevation view of a typical cylindrical lipstick tube and its cap.
Figure 2:
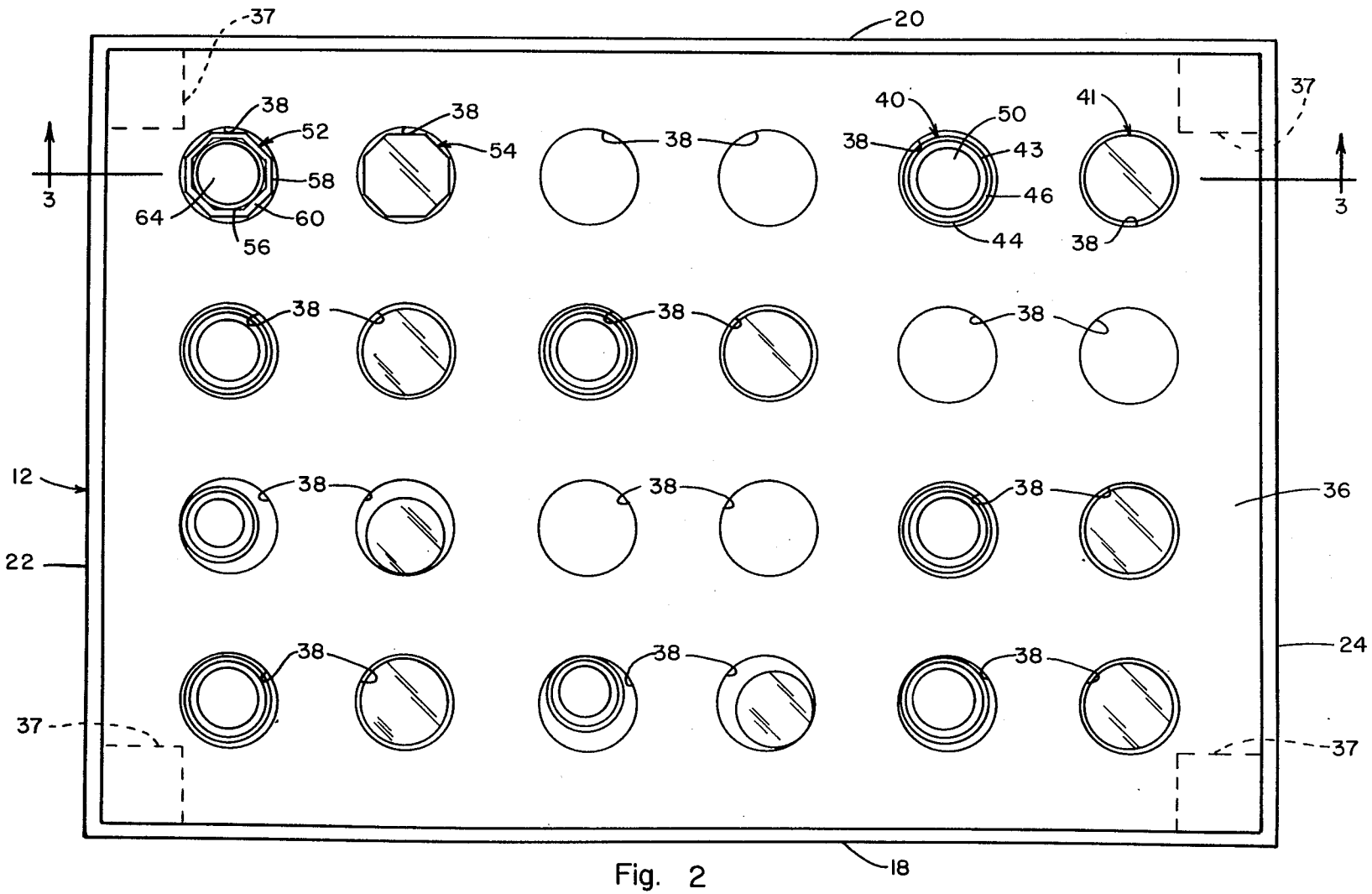
FIG. 2 is an enlarged top plan view of the bottom section of the case for storing and displaying lipstick with the top section removed and illustrating the positioning of lipstick tubes and caps within the bottom section.
Figure 3:
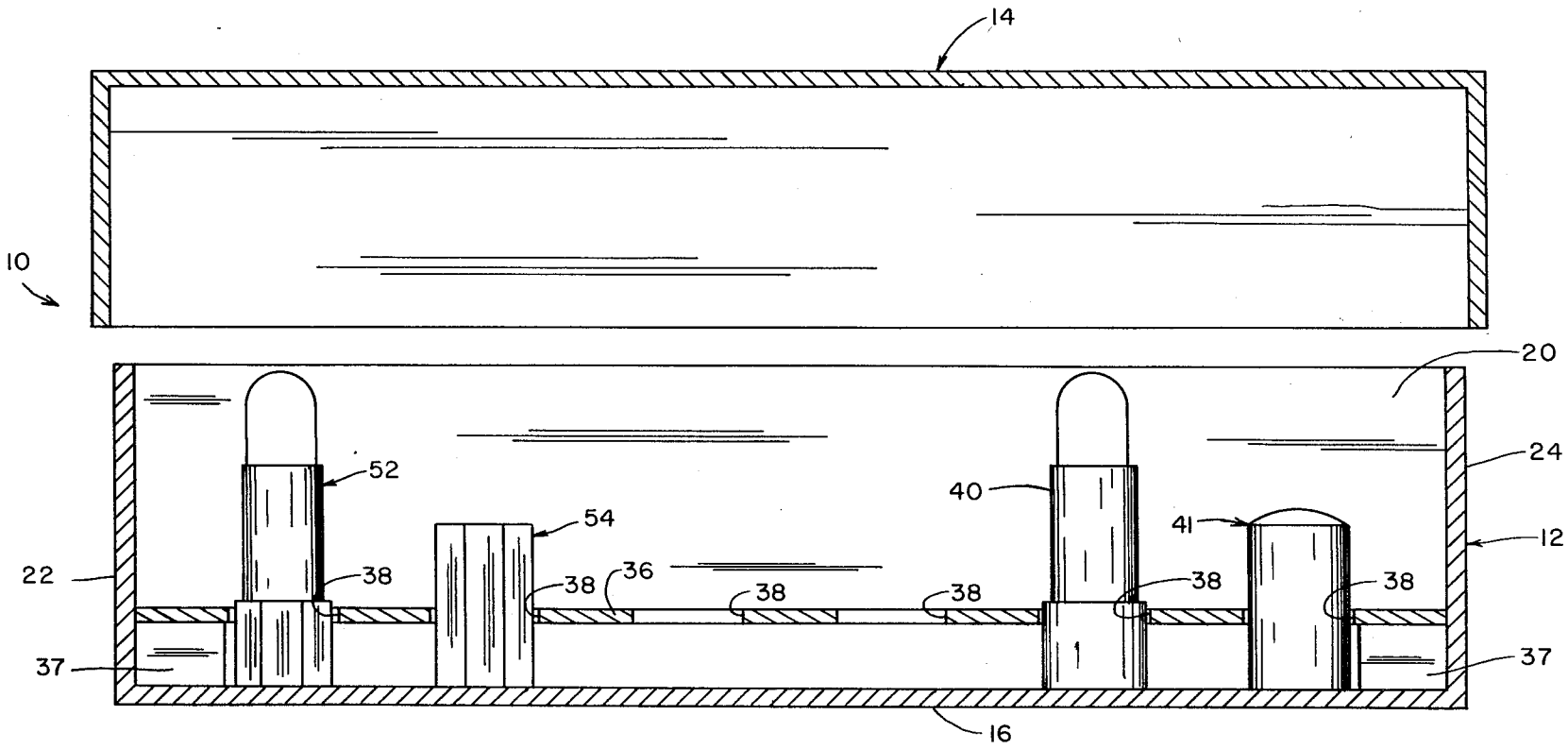
FIG. 3 is a vertical sectional view through the bottom section along the line 3—3 of FIG. 2 and additionally through the top section with examples of lipstick tubes and caps in place but not drawn in section.

FIG. 4 shows a typical example of a tube 40 and its cap 41 which has a lower rim 42. The tube 40 has a body 43 of one diameter, a base 44 of a diameter slightly larger than the body 43, and an annular shoulder 46 defined between the base 44 and the body 43. Typically, the base 44 has a flat bottom 48 and the lower rim 42 of the cap 41 is in a plane, so the tube 40 can stand on its base 44 and the cap 41 can stand on its rim 42. Lipstick 50 of a particular color and shade is contained within the tube 40. In the example shown in FIG. 4, the tube 40 and its cap 42 are cylindrical in cross section.

Figure 5:
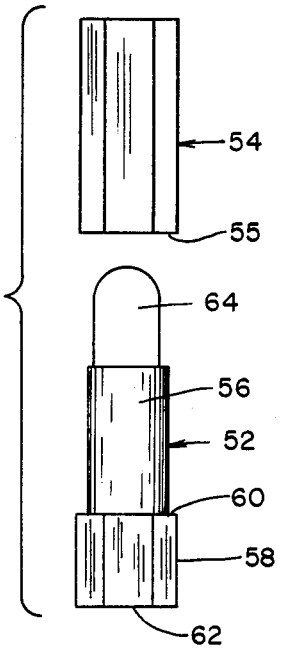
FIG. 5 is a side elevation view of a typical polygonal lipstick tube and its cap.

Another typical example of a lipstick tube 52 and its cap 54, which has a lower rim 55, are shown in FIG. 5. The tube 52 has a body 56 and a base 58 with a surrounding shoulder 60 between the base 58 and the body 56. The base 58 has a flat bottom 62 and the lower rim 55 of the cap 54 is in a plane. Lipstick 64 of another color (typically) is contained within the tube 52. In the example shown in FIG. 5, the tube 52 including its base 58 and its body 56, and the cap 54, are polygonal in shape.

The diameters of the holes 38 (which normally are all the same) should be slightly greater than the largest diameter of the tubes and caps of the collection, such as of the base 44 and the cap 41 or of a circumscribed circle about the base 58 or about the cap 54.

The lipstick tubes and caps illustrated in FIGS. 4 and 5 are typical examples of sizes and shapes of lipstick containers. Although the diameters and heights of tubes and caps will vary considerably, it has been determined that the tubes and caps of most of the commercially available lipsticks have a maximum diameter of about $\frac{3}{4}$ inch and a maximum height from the base 48 or 62 to the top of the lipstick 50 or 64 of about 3 inches. Accordingly, the holes 38 should be slightly larger than about $\frac{3}{4}$ inch in diameter and the front, back, and side walls 18, 20, 22, and 24 should space the top panel 26 more than 3 inches above the bottom panel 16, such as about $3\frac{1}{4}$ to $3\frac{1}{2}$ inches.

Also, it is preferred that the tray 36 be spaced as high as possible above the bottom panel 16, but no higher than the minimum height of the base of a tube, such as the bases 44 and 58. The minimum base height of most of the commercially available lipstick tubes has been determined to be about $\frac{1}{2}$ inch. Therefore, the tray 36 is preferably about $\frac{1}{2}$ inch above the bottom panel 16. While the relatively smaller diameter tubes and caps will fit loosely within the holes 38 and may wobble when the case 10 is moved, it has been determined that the tubes and caps will be restrained by the walls that define the holes 38 and will not tip over in normal use, and all the holes can be of the same size. This makes construction of the case 10 inexpensive and prevents its use from becoming complicated.

Figure 6:
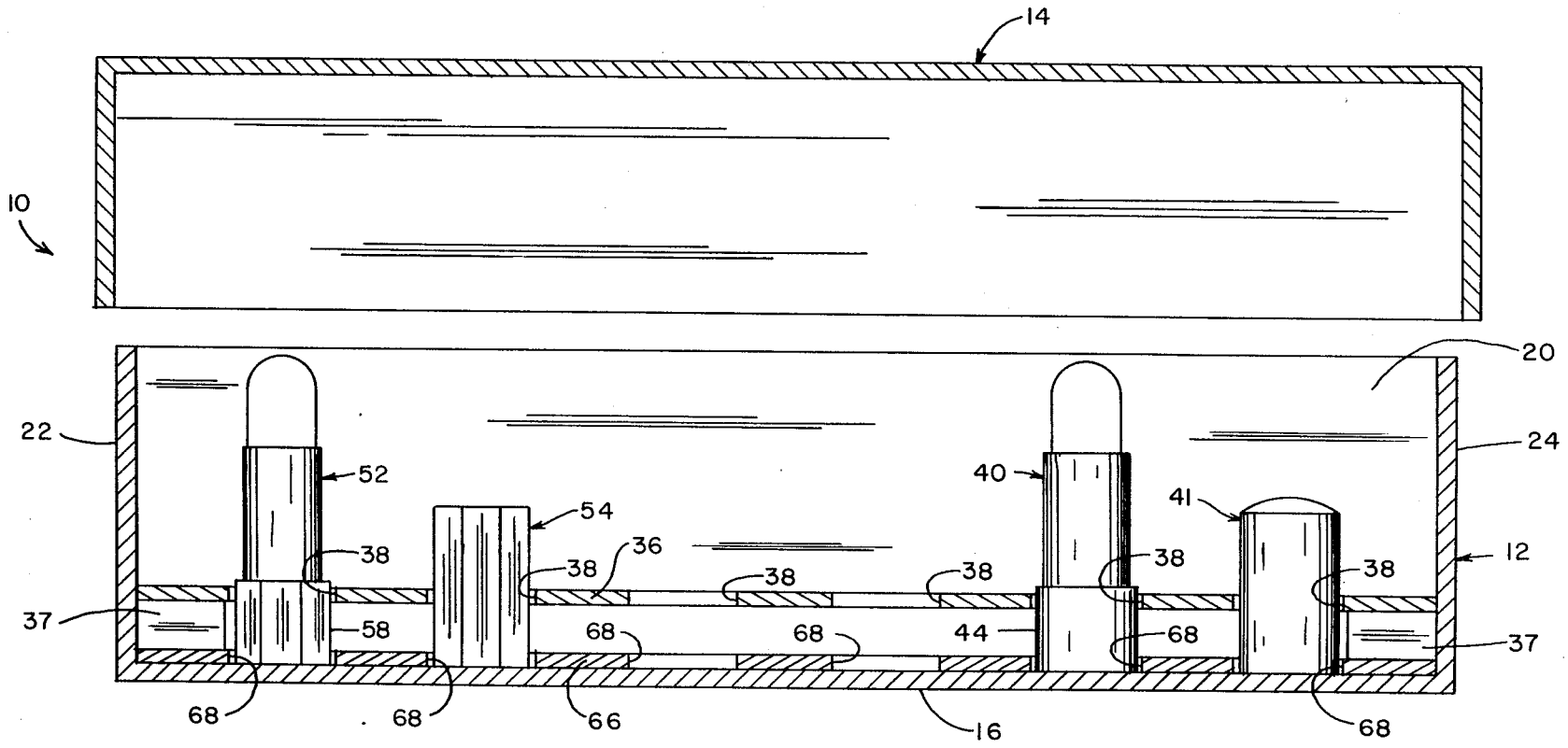
FIG. 6 is a vertical section view similar to that of FIG. 3, but showing a modification of the invention.

FIG. 6 illustrates a modification of the invention wherein another tray 66 is positioned within the bottom section 12. The tray 66 may rest against the bottom panel 16 and be removable therefrom or it may be glued permanently in place. If desired, the tray 66 can be supported slightly above the bottom panel 16. There are holes 68 through the tray 66. These holes 68 should be aligned with the holes 38 in the tray 36 so the tubes and caps will extend through the holes 68. In this manner, the tray 66 stabilizes the tubes and caps, better assuring against tipping of the tubes and caps when the case 10 is moved.

In use, the case 10 can be used to display a plurality of tubes and caps with the lipstick being exposed and facing upwardly. Each cap is preferably positioned adjacent its respective tube. The tubes extend upright with their flat bases resting on the bottom panel 16. Even though the tops of the caps may be rounded, their rims 42 or 55 will allow the caps to rest flat on the panel 16. Therefore, the owner of the lipstick can view all the colors of lipstick either by removal of the top section or, if the top panel is transparent, by looking through the top panel. Upon selecting a particular lipstick, the owner can remove its tube and the cap adjacent to it, put the cap on the tube, and use the lipstick for a period, such as a day. At the end of that period, the cap is removed from the lipstick and the tube and cap are replaced in their two holes 38. The spacing between the holes 38 allows the user's fingers to fit between the tubes and caps. This prevents smudging the fingers with lipstick and allows a grasp of either the tube or the cap for removal.

When the case 10 is not in use, the top section 14 is put in place, entirely enclosing the case 10 to prevent the admission of dust or other foreign matter. This allows the lipstick caps to be left off the tubes so that the array of lipstick colors can be viewed at any time upon simply removing the top section 14. In addition, if the top panel 26 is transparent, the colors within the case 10 can be viewed without removal of the top section 14. This is particularly desirable in the event the owner has more than one case 10 and desires to determine by looking at the lipstick colors which case to open.

The case 10 can be kept anywhere and the lipstick will be protected. If in a drawer, other objects may strike the case, but they will not contact the lipstick. The case 10 may be used commercially as a display of lipstick. In the latter instance, a case of larger capacity may be desired and a transparent top panel 26 may be particularly advantageous.

The case 10 can also be put in a refrigerator to store the lipstick in a refrigerated environment. With the top section 14 in place, the uncapped lipstick is nevertheless protected against contact with anything in the refrigerator and against exposure to food odors. Again, to select a particular lipstick, the case 10 is removed from the refrigerator, the top section 14 is removed, the colors are viewed, and a choice of lipstick is made.

Thus there has been shown and described a case for displaying lipstick, which case fulfills all of the objects and advantages sought therefor. Many changes, modifications, variations, and other uses and applications of the present contruction will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. In a package including means to receive and display a plurality of lipsticks of the kind having a tube with lipstick protruding therefrom and having a removable cap to expose the protruding lipstick, a case for storing and displaying the lipstick with the caps removed and the lipstick protruding therefrom comprising a bottom section formed of rigid plastic and a top section formed of rigid plastic that together define an enclosure, the bottom section having a flat bottom panel adapted to support the case on a normally horizontal surface, the top section having a top panel, a generally flat tray within the bottom section of the case, means to support the tray with its upper surface in spaced substantially parallel relationship to the bottom panel, an even numbered plurality of holes through the tray adapted to receive a plurality of the lipstick-containing tubes and their caps, the tubes being of the kind having a flat base and having a removable cap and the holes being sized to receive either the tubes or the caps so that the uncapped tubes can be received in some of the holes with the lipstick colors exposed and the caps can be received in other of the holes, wherein some of the tubes are cylindrical in cross section and some of the tubes are polygonal in cross section, the minimum diameter of the holes being greater than the maximum diameter of most of the cylindrical tubes and the caps therefor and of the diameter of a circumscribed circle around and in contact with the vertices of most of the polygonal tubes and of the caps therefor, the height of the tray above the bottom panel being less than the mininum height of the tubes and of the caps therefor, the holes being spaced from one another by a distance greater than the thickness of the thumb or finger of at least most people, the top section being displaceable from the bottom section to allow access from above to the bottom section and being replaceable to substantially close the enclosure for protection against the entry of dust and particulates into the enclosure, means defining a side wall surround on one of the case sections extending between the bottom panel and the top panel, the height of the side wall surround being greater than the height of the tallest of most of the tubes and their exposed lipstick and of the respective caps therefor, whereby when the top section is displaced from the bottom section, each of the lipstick tubes can be passed through a hole and be placed with its base on the bottom panel and can be removed therefrom and each of the caps can be passed through a hole adjacent to its respective tube with an end of the cap resting on the bottom panel and can be removed therefrom, to thereby expose the lipstick colors, and whereby the top section can be replaced to close the enclosure thereby permitting the tubes to be stored uncapped without exposure to dust and foreign matter.

2. The case of claim 1 wherein the holes are between about $\frac{5}{8}$ inch in diameter and about $\frac{3}{4}$ inch in diameter.

3. The case of claim 1 wherein there are between twelve and twenty-eight holes.

4. The case of claim 1 wherein there are between twenty-two and twenty-six holes.

5. The case of claim 1 wherein the holes through the tray are in rows and wherein each row consists of an even number of holes.

6. The case of claim 1 wherein the bottom and top panels are rectangular.

7. The case of claim 1 wherein the holes through the tray are at least twelve in number.

8. The case of claim 1 wherein the tray is removeable to permit cleaning of the case and the tray.

9. The case of claim 1 wherein the top panel is sufficiently transparent to permit the lipstick colors to be seen through the top panel.

10. The case of claim 1 wherein the holes are separated from one another by at least $\frac{5}{8}$ inch.

11. The case of claim 1 including a second tray positioned below and spaced from the first-named tray, a plurality of holes through the second tray and sized like and vertically aligned with the holes through the first-named tray.

* * * * *